US005807064A

United States Patent [19]

Dudash

[11] Patent Number: 5,807,064

[45] Date of Patent: Sep. 15, 1998

[54] APPARATUS FOR CONTINUOUSLY VARYING THE POSITION OF AN ARTICLE CARRYING PLATFORM

[75] Inventor: George M. Dudash, Escondido, Calif.

[73] Assignee: Baldwin Technology Corporation, Rosemont, Ill.

[21] Appl. No.: 539,764

[22] Filed: Oct. 5, 1995

[51] Int. Cl.[6] ..... B65G 6/00

[52] U.S. Cl. ..... 414/790; 318/812

[58] Field of Search ..... 414/789.1, 790, 414/793.4, 793.8, 794.6, 788.1; 318/772, 812, 814

[56] References Cited

U.S. PATENT DOCUMENTS

| | | | |
|---|---|---|---|
| 3,739,924 | 6/1973 | Stobb . | |
| 3,825,134 | 7/1974 | Stobb . | |
| 4,403,900 | 9/1983 | Thomas | 414/788.8 |
| 4,489,264 | 12/1984 | Dabney | 318/812 |
| 4,541,763 | 9/1985 | Chandhoke et al. | 414/790 |
| 4,772,003 | 9/1988 | Nobuta et al. | 414/790 |
| 4,772,169 | 9/1988 | Masini | 414/41 |
| 4,953,845 | 9/1990 | Castiglione | 271/217 |
| 5,073,081 | 12/1991 | Johnson | 414/793.4 |
| 5,215,428 | 6/1993 | Masini | 414/789.5 |

*Primary Examiner*—Karen M. Young
*Assistant Examiner*—Gregory A. Morse
*Attorney, Agent, or Firm*—Roberts & Mercanti,L.L.P.

[57] ABSTRACT

An apparatus for continuously varying the position of an article carrying platform in response to an inflowing stream of articles placed on the platform. The platform positioning apparatus finds use as part of a vertical stacking machine which stacks an inflowing stream of signatures on the platform. It has a position sensor for detecting the position of the platform and providing a platform position signal to a controller. A controller issues a translation signal to a translation motor responsive to the platform position signal. The translation motor causes the bidirectional translation of the platform responsive to the translation signal from the controller.

32 Claims, 4 Drawing Sheets

APPARATUS FOR CONTINUOUSLY VARYING THE POSITION OF AN ARTICLE CARRYING PLATFORM

BACKGROUND OF THE INVENTION

1. Field of the Invention

The invention relates to an apparatus for continuously varying the position of an article carrying platform in response to a continuous stream of articles placed on the platform. More particularly, the invention relates to a platform positioning apparatus in a stacking machine which stacks an inflowing stream of signatures onto the platform.

2. Description of the Prior Art

In the paper handling and printing industries it is necessary to quickly stack a stream of articles such as printed sheets as they exit high speed processing equipment, such as printing presses. Typically, the processing equipment delivers planar or folded sheets in signature form onto conveyors in serial, imbricated form which then must be stacked into large rectangular bundles for delivery to a customer or secondary process such as a bindery. Sheet stacking devices are commonly used for this purpose, however, it has been a problem in the art to provide equipment which adequately handles the sheets at the high speeds at which they are delivered to the stacker.

Sheet material is commonly delivered to a stacking machine in the form of magazines, books, or folded sheet signatures which are to be assembled to form a magazine or book. Vertical stackers are well known in the art as exemplified by U.S. Pat. Nos. 3,739,924; 3,825,134; 4,772,169; 4,953,845 and 5,215,428, which are incorporated herein by reference. Features common to prior art stackers are that they receive sheets, assemble them into a rectangular, vertical stack and compress the stack to remove entrained air. As used herein, "vertical" includes a stack which may be formed at any angle including those from true vertical to about 45° from true vertical. In most vertical stackers in use today, a stack is actually formed at a slight angle to true vertical. As used herein, the term "platform" means a device for holding and transporting articles. The platform may be positioned horizontally, vertically or at any other convenient angle.

Current stacking equipment rapidly collects and stacks sheets at the speed they are produced onto an elevator platform. The problem in the art is that signature thicknesses vary very widely and the stacking equipment must be able to handle such variations. Signatures which are very thick fill the platform very quickly. The platform therefore must be able to be controlled to descend from an upper loading position to a lower loading position very quickly. Signatures which are very thin, for example single sheet signatures, fill the platform very slowly. The platform therefore must be able to be controlled to descend rather slowly. In addition, once the platform is unloaded, it should be able to rise back up to its highest loading position extremely quickly in order to maximize production and avoid damage to oncoming signatures. A problem with current vertical stackers is their disadvantageous system for controlling the descent of the stacking platform to provide the best possible stacking. Prior art stackers control the speed of descent of platforms rather than platform position. Feedback servo-control methods for controlling speed responsive to a top-of-stack position indicator are costly. One existing method for controlling platform descent is to use a proportional, analog feed back device with a direct coupling to a motor controller. Another system is to manually control the machine by an operator exercising special skill and judgment.

Stackers which control speed attempt to match the bundle build rate, which is a function of the rate at which signature are delivered to the stacking area (typically described as signatures per hour), the number of pages in each signature, the thickness or caliper of each page in the signature, and the packing density created by the dynamic forces resulting from the interaction of the machine's stacking elements and the effectiveness of the control. This prior art requirement to closely match speeds means that the stacker controls need to produce platform descent speeds as low as about 0.0167 inch/second or as great as about 1.4 inch/second. The inability to precisely control speed results in positioning errors such that the platform is frequently too high or too low. In addition, when the platform is returned to an upper position when not supporting articles, it is important to be able to return it as quickly as possible so that the succeeding bundle may properly be processed. This may require high speeds.

Several problems arise when one attempts to control the speed of a platform. Traditional DC drive systems do not have the appropriate speed following linearity to maintain the degree of control necessary. The speed reference signal used, and the gain or bias added to maintain the same relative speed if the inflow speed increases, is not sufficiently accurate. The best current nonservo linear controllers are approximately ±2% from the required speed. DC drives have difficulty with the torque requirements through the range from very low speeds to high speeds. The application of properly tuned servo-drives can provide the necessary linearity, however, speed following servo-systems are expensive.

Prior systems have typically required the use of a sensor to sense the top position of the building bundle, thereby providing an error signal (or deviation signal) which is used to further condition the speed control system by producing more or less gain in the speed signal as a function of the magnitude of the error. Unique disturbances in the inflow process, such as gaps between signatures which differentiate one bundle from the next, and changes in paper caliper or packing density require the ability to control the stacking table position, not only the relative speed of the stacker and not only the height of the platform plus the stack. In addition, stackers which control the speed of the platforms only control the speed of descent during loading of articles. They do not reverse direction to correct for overshoot or platform drift conditions. Hence there is only one-way correction since the platform does not backup. In addition, they do not control a platform which does not have a stack on it. In short, prior stacker controllers are not platform position controllers, rather they are speed controllers responsive to a top of stack sensor signal. The error therefore has two variables, namely platform position error and stack height error. Prior controllers only respond to the sum of these errors.

It would be desirable to be able to automatically control platform position responsive to variations in signature thickness, inflow speed and gaps between signatures. It would also be desirable to achieve bidirectional control for the position of the platform. That is, in both the back and forth horizontal and up and down vertical positions, as well as positions at other angles. The present invention provides an automated system for receiving and stacking articles on a translating platform whereby the platform position can be controlled and adjusted depending on the inflow of the articles to be stacked as well as adjusting for unique inflow disturbances. The present invention controls platform position responsive to two inputs, namely, the position where the platform is and the position of article stack height. This invention has also found a unique use of a motor control a.c. inverter and an a.c. motor in a servo control system.

SUMMARY OF THE INVENTION

The invention provides an apparatus for continuously varying the position of a platform along a path, responsive to a flow of articles onto the platform. It comprises a platform position sensor means capable of detecting the position of the platform responsive to a flow of articles onto the platform and providing a platform position signal to a controller. It further has a controller connected to the platform position sensor, capable of issuing a translation signal to translation means responsive to the platform position signal. It also comprises position translation means capable of the bidirectional translation of the platform responsive to the translation signal from the controller.

The invention also provides an apparatus for stacking sheets comprising sheet feeding means capable of feeding a series of sheets in signature form to sheet stacker means. It has sheet stacker means capable of continuously receiving sheets from the sheet feeding means and stacking the sheets into a substantially vertical stack onto at least one platform. It further has compressor means capable of compressing the stack and clamping means capable of securing the sides of the sheets in the compressed stack. Transporting means move the stack along a path from a first position to a second position. It also has the above means for continuously varying the vertical position of the at least one platform along a path, responsive to a continuously varying stack placed on the platform.

The invention still further provides a nonlinear digital to analog converter comprising a programmable logic controller capable of receiving a digital input signal and a plurality of resistors arranged in an array. An input of each resistor is connected in parallel to discrete output lines of the programmable logic controller and an output of each resistor is connected to a common bus. The programmable logic controller is capable of generating a signal at an input of one or more selected resistors to thereby form a resistor output at each selected resistor. The combination of the resistor outputs generates an analog output signal on the bus.

The invention further provides a method for continuously varying the position of a platform along a path, responsive to a flow of articles onto the platform which comprises:

I) providing the above apparatus;

II) detecting the position of the platform with the platform position sensor means, responsive to a flow of articles onto the platform and providing a platform position signal to a controller; and III) causing the controller to issue a translation signal to translation means responsive to the platform position signal; and IV) causing the position translation means to translate the platform responsive to the translation signal from the controller.

DETAILED DESCRIPTION OF THE PREFERRED EMBODIMENT

Figure 1:
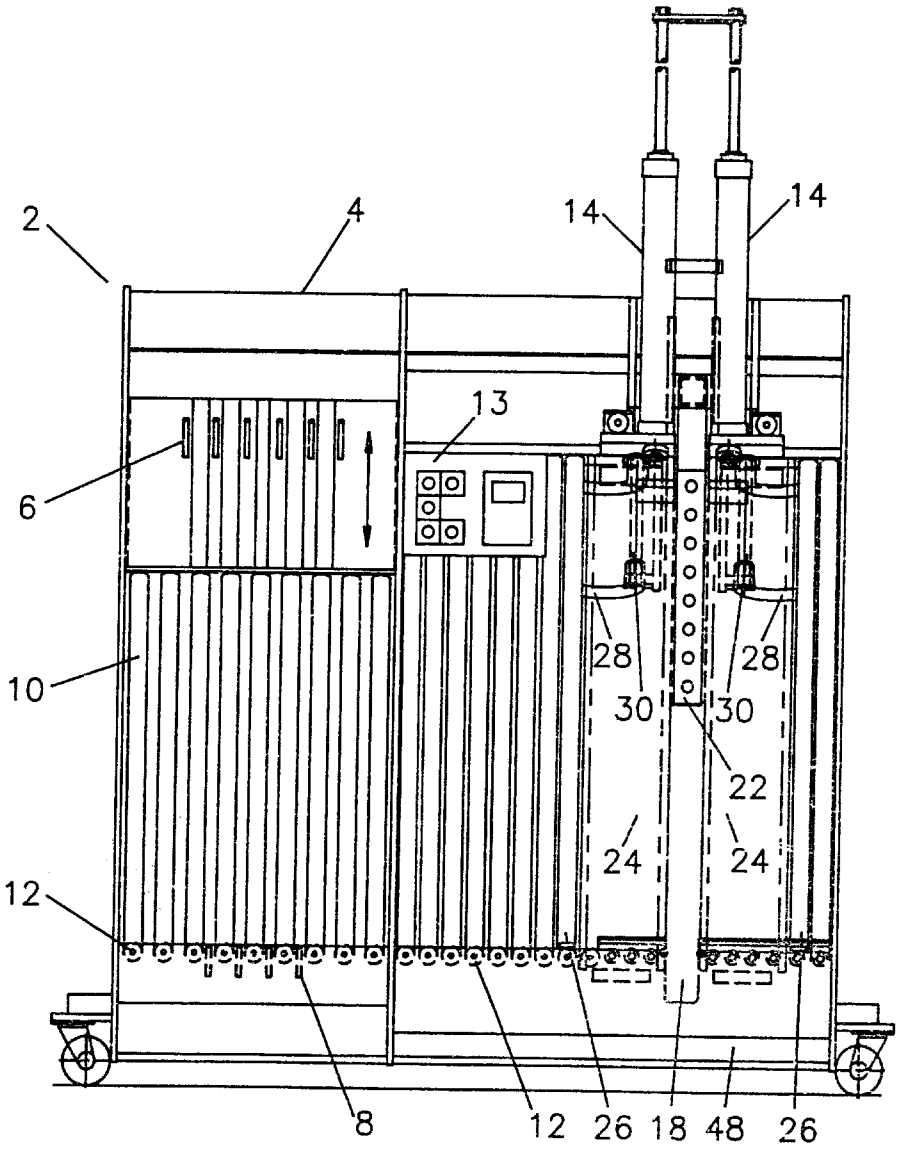
FIG. 1 shows a front elevational view of a vertical stacker according to the invention.

FIG. 1 shows a front view of a vertical sheet stacker 2 according to the invention. It shows a delivery device 4 which receives sheets in a shingled stream. The sheets are carried to the upper end of the delivery device 4 and are stripped from their stream in imbricated form and are placed into an aligned stack. The sheets are stacked into a slightly inclined collection onto an upper platform which is in the form of a series of upper support fingers 6. The upper platform is capable of travelling an up and down path in the direction of the arrow as shown. This upper platform 6 collects the signatures in vertical form and, as the stack grows, it slowly descends in a controlled manner. When upper platform 6 reaches its lowermost position of travel, it retracts into the stacker and the stack is transferred to a lower platform which is in the form of a series of lower support fingers 8. Lower platform 8 travels up and down between slightly inclined vertical support rollers 10 which provide back support to the stack. Preferably either manually or automatically positioned on the lower support fingers 8 is a plywood bottom end board which protects the lowermost signatures during subsequent movement, compression and strapping. In operation, the lower platform 8 rises up to meet the stack growing on the upper platform 6. Upper platform 6 then retracts and transfers the stack to the lower support platform 8. The lower platform transfers the stack to horizontal support rollers 12. When the stack is of full size, the formed stack is caused to travel to the right along the horizontal support rollers 12 to a compression station. Preferably, a protective plywood top end board is placed, either manually or automatically, on the stack before the stack enters into the compression station. Operation of the stacker may be controlled by control panel 13. The compression station comprises a pair of rams 14 which press down onto the stack to remove entrained air and reduce the height of the stack. The rams 14 extends along a plane parallel to the plane of the incline of the stack and press downwardly on the stack to compress the stack against the horizontal support rollers.

A bundle clamp is applied to the stack to hold the stack steady during compression and strapping. The clamp is comprised of a pair of opposing bars 26 which compress the stack on opposite sides thereof. Each bar is attached to driving means which alternately drives the bars against the stack during strapping and then releases the stack. The driving means preferably comprises a pair of curved connecting members or C-shaped rods 28 which are attached to each bar at one end of each bar. The curved connecting members 28 are attached at one end to one of the bars and at another end to pivoting means 30. While clamp bar 26 and ram 14 are applied to the bundle 16, a strap is tied around the bundle via strapping mechanism 18 which may be controlled by control panel 22. In the preferred embodiment, vertical support rollers 10 are substituted by slide-by panels 24 in the compression zone. The stacker may be constructed around a surrounding baseplate 48.

Figure 2:
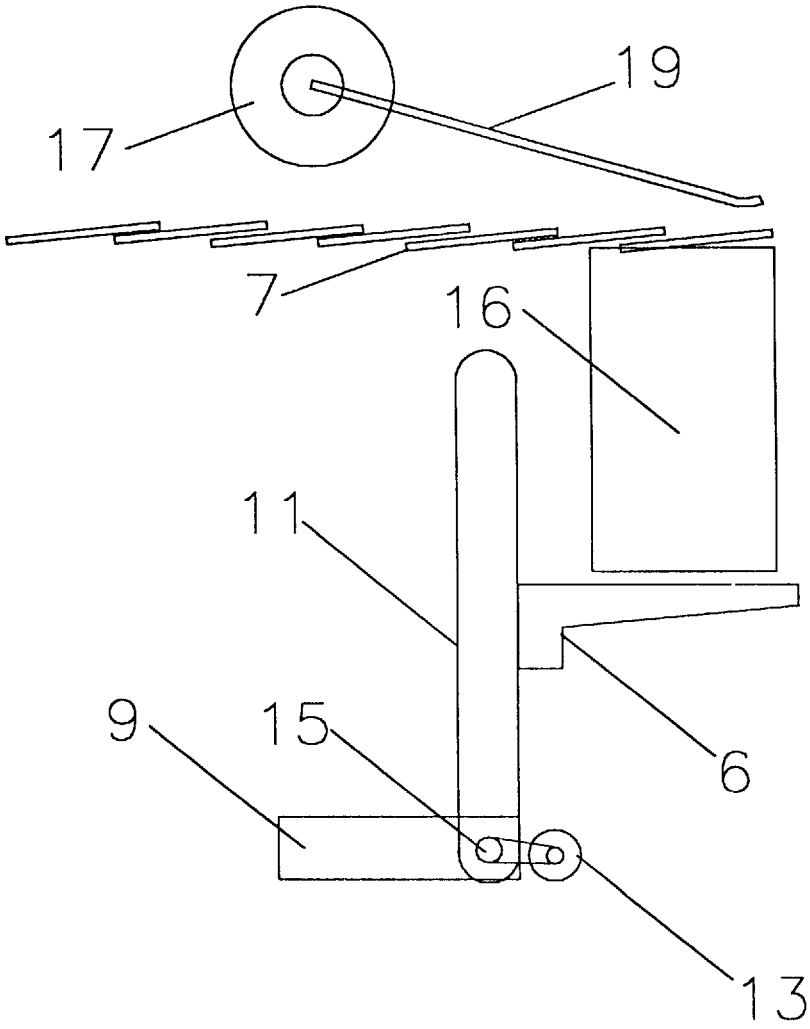
FIG. 2 is a schematic representation of a side view of a stacker in operation.

FIG. 2 is a schematic representation of a side view of a stacker according to this invention in operation. Platform 6 is initially positioned at an uppermost position along its vertical path of travel. Incoming stream of signatures 7 are deposited onto platform 6 in the form of an ever increasing rectangular stack 16. Platform 6 is driven either up or down by AC drive motor 9 via a chain drive mechanism 11. A.C. drive motors are preferred since they do not have brushes which tend to wear out.

The position of the platform is monitored by a platform position encoder 13. The platform position encoder is preferably a model 725T, 1000 pulse per revolution, differential incremental encoder available commercially from Encoder Products Company of Sandpoint, Id. The platform position encoder 13 is driven by a shaft 15 attached to drive motor 9 and chain drive mechanism 11. The shaft is approximately ⅜ inch in diameter. The A.C. drive motor is preferably a model F046A commercially available from the U.S. Motors Division of Emerson Electric Company of St. Louis, Mo. Platform position encoder 13 generates a platform position signal in the form of pair of signal pulses, 90° out of phase, which indicates the direction of the shaft and how much the shaft is turning. These convert into instantaneous platform position. The pulse resolution is approximately 1000 pulses per revolution of the shaft which results in a platform position resolution of about 0.010 inches per pulse. These parameters are not critical. In the preferred embodiment, the stacker has stack sensor means capable of detecting the highest vertical position of the stack. Preferably, the stack sensor means comprises an absolute encoder 17 attached to lever arm 19. The absolute encoder is preferably a model R25 Absolute Position Encoder available commercially from BEI Sensors and Motion Systems Company of Sylmar, Calif. The lever arm 19 may be a steel bar approximately 16 inches long, 1 inch wide and 1/16 inch thick. One end of the steel bar is free to track the top of the growing stack and the other end is attached to the central shaft of the absolute encoder. The deflection of the lever arm 19 due to the height of the stack 16 causes the absolute encoder 17 to issue a digital stack position signal. The signal is a ten bit parallel output in Gray code, which approximates a binary signal. This provides an essentially noise free signal based on shaft deflection. Other methods to sense the top of the stack may be used.

Figure 3:
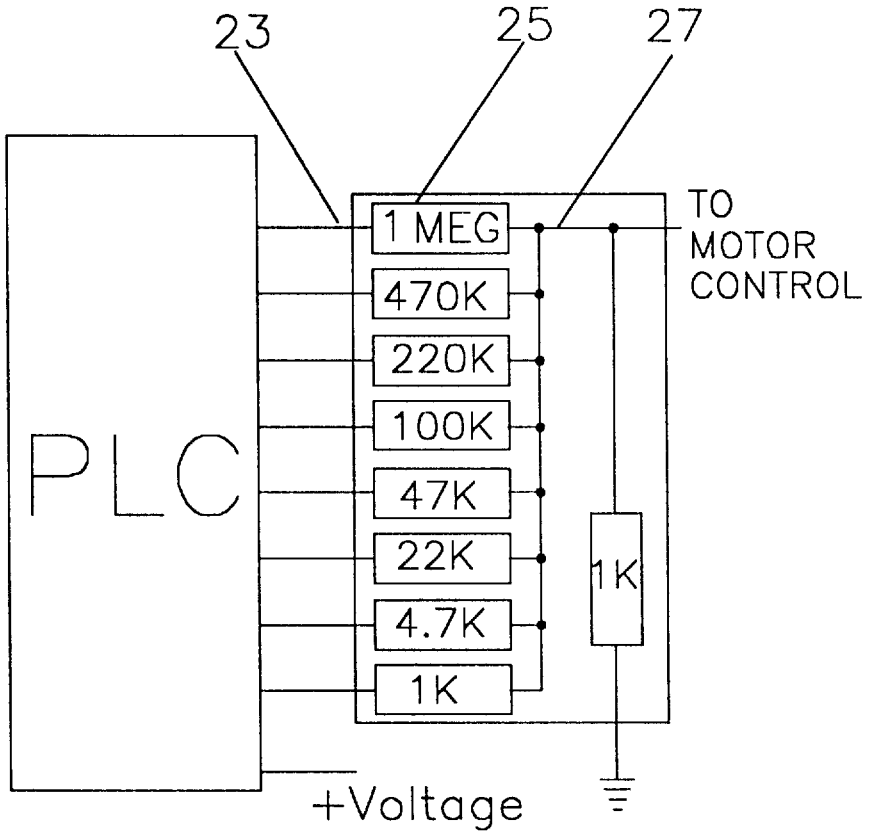
FIG. 3 is a schematic representation of a nonlinear digital to analog converter useful for the invention comprising a programmable logic controller and plurality of resistors arranged in an array.
Figure 4:
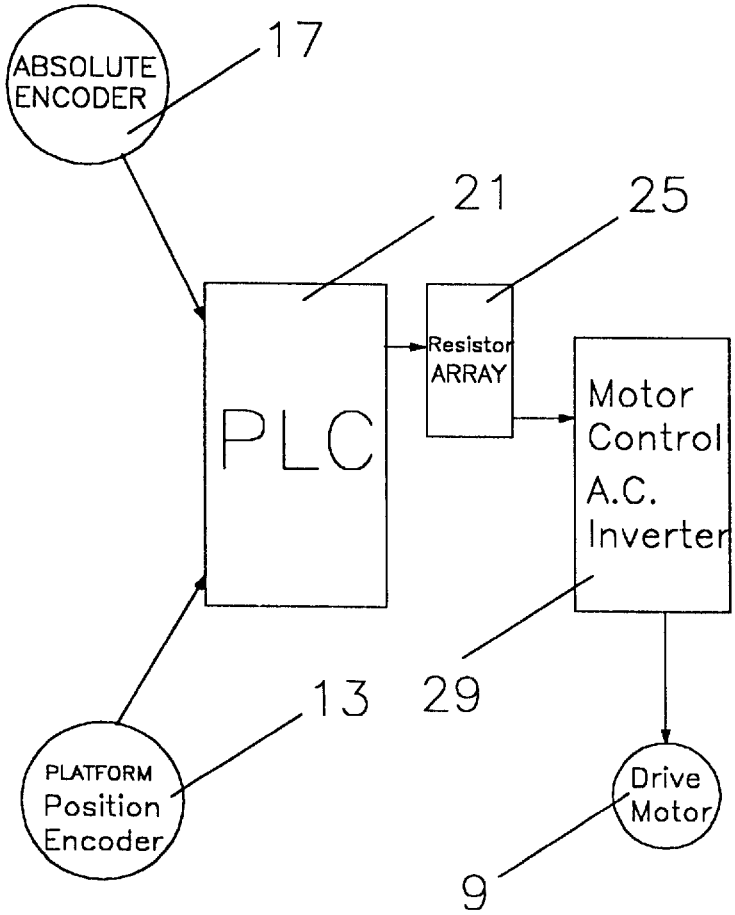
FIG. 4 is a schematic representation of the nonlinear digital to analog converter receiving a platform position signal and article position signal and issuing a vertical translation signal to an alternating current invertor and alternating current motor drive.

As best seen in FIGS. 3 and 4, the stack senor signal from absolute encoder 17 and the platform position signal from platform position encoder 13 are directed for processing to programmable logic controller (PLC) 21. In the preferred embodiment, the PLC is a suitable Mitsubishi FX series controller. The PLC has parallel outputs which selectively generate a signal at an input at one or more selected resistors in array 25 thereby forming an analog resistor output at each selected resistor. The combination of the resistor analog outputs forms a translation signal on bus 27. As used herein, the translation signal is the control signal which causes platform movement action. In the preferred embodiment, each resistor has a different resistance value from the other resistors. More preferably, the resistors each have a sequential resistance value which differs from its adjacent resistors by about a multiple of 2. Most preferably, the plurality of resistors have resistance values of about 1K ohms, about 2.2K ohms, about 4.7K, about 10K ohms, about 22K ohms, about 47K ohms, about 100K ohms, about 220K ohms, about 470K ohms and about 1 megohms as shown in FIG. 3. The combination of resistor outputs generates an analog output signal on the bus 27 which serves as an input to motor control A.C. inverter 29. The motor control A.C. inverter is preferably a model 1305-AA04A adjustable frequency a.c. drive, commercially available from Allen-Bradley Company of Milwaukee, Wis. This inverter generates a three phase frequency signal which controls the operation of A.C. motor drive 9 which in turn drives the chain drive mechanism 11 and platform 6 up or down to the proper position.

The combination PLC and resistor array forms a curved, or nonlinear digital to analog converter. The programmable logic controller receives a digital input signal and issues a signal to one or more of the resistors arranged in the array. An input of each resistor is connected in parallel to discrete output lines of the programmable logic controller and an output of each resistor is connected to a common bus. The programmable logic controller generates a signal at an input of one or more selected resistors to form a resistor output at each selected resistor, the combination of which resistor outputs generates an analog output signal on the bus. Known digital to analog converters linearly convert a digital input to an analog voltage output. These take the entire spectrum range of signals to be potentially converted and divides the entire range into equal parts. The present non-linear digital to analog converter provides for a higher resolution of control at one end of the control spectrum and a lower resolution of control at the other end of the control spectrum. This is done by varying the resistor values. This control provides a higher resolution of control in the portion of the control region where tight control is needed. For example, the converter can provide a high degree of position resolution control while signatures are stacking on the platform. Then, at the point in time where the stack is removed from the platform at the bottom of its path of travel, the platform can be returned to its uppermost position at the top of its path of travel, i.e. empty, very quickly at a low position control resolution. A low resolution zone allows the controller to perform fewer calculations and hence one does not need to use a more expensive PLC to handle more data bits than necessary for the degree of control required.

What is claimed is:

1. An apparatus for continuously varying the position of a platform along a path, responsive to a flow of articles onto the platform which comprises:

a) platform position sensor means capable of detecting the position of the platform along the path responsive to a flow of articles onto the platform and providing a platform position signal to a controller; and b) a controller connected to the platform position sensor, capable of issuing a translation signal to translation means responsive to the platform position signal; and c) position translation means capable of the bidirectional translation of the platform responsive to the translation signal from the controller.

2. The apparatus of claim 1 wherein the controller comprises a programmable logic controller which receives the platform position signal.

3. The apparatus of claim 2 wherein the controller comprises a plurality of resistors each capable of receiving input signals from the programmable logic controller and generating an analog output translation signal, and each having a different resistance value from the other resistors.

4. The apparatus of claim 3 wherein the plurality of resistors each have a sequential resistance value which differs from its adjacent resistors by about a multiple of 2.

5. The apparatus of claim 4 wherein the controller comprises a programmable logic controller which receives the platform position signal and generates a signal at an input of one or more selected resistors and thereby form a resistor output at each selected resistor, the combination of which resistor outputs forms the translation signal.

6. The apparatus of claim 5 wherein the programmable logic controller additionally receives an article position signal from article sensor means capable of detecting the position of the articles and wherein the translation signal is responsive to both the platform position signal and the article position signal.

7. The apparatus of claim 3 wherein the controller comprises a programmable logic controller which receives the platform position signal and generates a signal at an input of one or more selected resistors and thereby form a resistor output at each selected resistor, the combination of which resistor outputs forms the translation signal.

8. The apparatus of claim 7 wherein the programmable logic controller additionally receives an article position signal from article sensor means capable of detecting the position of the articles and wherein the translation signal is responsive to both the platform position signal and the article position signal.

9. The apparatus of claim 3 wherein the plurality of resistors have resistance values of about 1K ohms, about 2.2K ohms, about 4.7K ohms, about 10K ohms, about 22K ohms, about 47K ohms, about 100K ohms, about 220K ohms, about 470K ohms and about 1 megohms.

10. The apparatus of claim 2 wherein the programmable logic controller additionally receives an article position signal from article sensor means capable of detecting the position of the articles and wherein the translation signal is responsive to both the platform position signal and the article position signal.

11. The apparatus of claim 1 wherein the translation means is capable of the vertical or horizontal translation of the platform.

12. The apparatus of claim 1 further comprising article sensor means capable of detecting the position of the articles and providing an article position signal to the controller and wherein the translation signal is responsive to both the platform position signal and the article position signal.

13. An apparatus for stacking sheets comprising:

i) sheet feeding means capable of feeding a series of sheets in signature form to sheet stacker means;

ii) sheet stacker means capable of continuously receiving sheets from the sheet feeding means and stacking said sheets into a substantially vertical stack onto at least one platform:

iii) compressor means capable of compressing the stack:

iv) clamping means capable of securing the sides of the sheets in the compressed stack;

v) means for continuously varying the vertical position of the at least one platform along a path, responsive to a continuously varying stack placed on the platform which comprises:

a) position sensor means capable of detecting the vertical position of the at least one platform and providing a platform position signal to a controller; and b) a controller connected to the position sensor, capable of issuing a translation signal to vertical translation means responsive to the platform position signal; and c) vertical translation means capable of the bidirectional vertical translation of at least one platform responsive to the translation signal from the controller.

14. The apparatus of claim 13 wherein the controller comprises a programmable logic controller which receives the platform position signal.

15. The apparatus of claim 14 wherein the controller comprises a plurality of resistors each capable of receiving input signals from the programmable logic controller and generating an analog output translation signal, and each having a different resistance value from the other resistors.

16. The apparatus of claim 15 wherein the plurality of resistors each have a sequential resistance value which differs from its adjacent resistors by about a multiple of 2.

17. The apparatus of claim 16 wherein the controller comprises a programmable logic controller which receives the platform position signal and generates a signal at an input of one or more selected resistors and thereby form a resistor output at each selected resistor, the combination of which resistor outputs forms the translation signal.

18. The apparatus of claim 17 wherein the programmable logic controller additionally receives a stack position signal from stack sensor means capable of detecting the highest vertical position of the stack and wherein the translation signal is responsive to both the platform position signal and the stack position signal.

19. The apparatus of claim 15 wherein the plurality of resistors have resistance values of about 1K ohms, about 2.2K ohms, about 4.7K ohms, about 10 ohms, about 22K ohms, about 47K ohms, about 100K ohms, about 220K ohms, about 470K ohms and about 1 megohms.

20. The apparatus of claim 19 wherein the programmable logic controller additionally receives a stack position signal from stack sensor means capable of detecting the highest vertical position of the stack and wherein the translation signal is responsive to both the platform position signal and the stack position signal.

21. The apparatus of claim 15 wherein the controller comprises a programmable logic controller which receives the platform position signal and generates a signal at an input of one or more selected resistors and thereby form a resistor output at each selected resistor, the combination of which resistor outputs forms the translation signal.

22. The apparatus of claim 14 wherein the programmable logic controller additionally receives a stack position signal from stack sensor means capable of detecting the highest vertical position of the stack and wherein the translation signal is responsive to both the platform position signal and the stack position signal.

23. The apparatus of claim 13 further comprising stack sensor means capable of detecting the highest vertical position of the stack and providing a stack position signal to the controller and wherein the translation signal is responsive to both the platform position signal and the stack position signal.

24. The apparatus of claim 23 wherein the stack sensor means comprises a digital absolute encoder.

25. The apparatus of claim 13 further comprising transporting means capable of moving the stack along a path from a first position to a second position.

26. The apparatus of claim 13 wherein the vertical translation means comprises an alternating current motor and an alternating current invertor drive.

27. The apparatus of claim 13 wherein the vertical translation means comprises a three phase alternating current motor and an alternating current invertor drive.

28. A nonlinear digital to analog converter which comprises a programmable logic controller capable of receiving a digital input signal, a plurality of resistors arranged in an array, an input of each resistor being connected in parallel to discrete output lines of the programmable logic controller and an output of each resistor being connected to a common bus, said programmable logic controller being capable of generating a signal at an input of one or more selected resistors to thereby form a resistor output at each selected resistor, the combination of which resistor outputs generates an analog output signal on the bus.

29. The nonlinear digital to analog converter of claim 28 wherein each resistor has a different resistance value from the other resistors.

30. The nonlinear digital to analog converter of claim 28 wherein the plurality of resistors each have a sequential resistance value which differs from its adjacent resistors by about a multiple of 2.

31. The apparatus of claim 29 wherein the plurality of resistors have resistance values of about 1K ohms, about 2.2K ohms, about 4.7K ohms, about 10K ohms, about 22K ohms, about 47K ohms, about 100K ohms, about 220K ohms, about 470K ohms and about 1 megohms.

32. A method for continuously varying the position of a platform along a path, responsive to a flow of articles onto the platform which comprises:

I) providing an apparatus comprising a) platform position sensor means capable of detecting the position of the platform along the path responsive to a flow of articles onto the platform and providing a platform position signal to a controller; and b) a controller connected to the platform position sensor, capable of issuing a translation signal to translation means responsive to the platform position signal; and c) position translation means capable of the bidirectional translation of the platform responsive to the translation signal from the controller;

II) detecting the position of the platform with the platform position sensor means, responsive to a flow of articles onto the platform and providing a platform position signal to a controller; and III) causing the controller to issue a translation signal to translation means responsive to the platform position signal; and IV) causing the position translation means to translate the platform responsive to the translation signal from the controller.

* * * * *